US005704856A

United States Patent [19]

Morse

[11] Patent Number: 5,704,856

[45] Date of Patent: Jan. 6, 1998

[54] BATTER SWING TRAINING AID

[76] Inventor: Bruce A. Morse, 8450 Tommy Dr., San Diego, Calif. 92119

[21] Appl. No.: 709,438

[22] Filed: Aug. 16, 1996

[51] Int. Cl.[6] ..... A63B 67/00

[52] U.S. Cl. ..... 473/422; 473/212

[58] Field of Search ..... 473/422, 518, 473/206, 207, 106, 212, 213, 214

[56] References Cited

U.S. PATENT DOCUMENTS

| | | | |
|---|---|---|---|
| 4,095,787 | 6/1978 | Saferstein | 473/423 |
| 4,350,338 | 9/1982 | May | 473/423 |
| 5,188,365 | 2/1993 | Picard | 473/212 |

*Primary Examiner*—Theatrice Brown

*Attorney, Agent, or Firm*—John R. Duncan; Frank D. Gilliam

[57] ABSTRACT

A device for training batters to properly shift weight to the back leg at the beginning of a swing and to shift weight to the front leg during a swing when striking the ball in baseball and similar games. The device includes a first strap for fastening to the leading leg just above the knee and a second strap for fastening to the leading wrist, "leading" being the side towards a pitcher. An elongated member connects the two straps and comprises an elastic portion and an adjustable length portion, which includes a separable buckle so that the elongated member can be separated without removing either strap. In use, straps are emplaced on the knee and wrist and the adjustable length portion is adjusted to be taut but not stretched with the batter in the "ready" position. At the start of a swing, the hands move back, stretching the elongated member to encourage weight movement to the back leg. When the forward swing and forward stride begin, the elongated member will be stretched forwardly to encourage weight shift to the forward leg. Proper weight shift will provide maximum batting stroke power.

11 Claims, 1 Drawing Sheet

BATTER SWING TRAINING AID

FIELD OF THE INVENTION

This invention relates to apparatus for training baseball batters to swing in an optimum manner. In particular, to train a batter to shift his or her weight from the back leg to the front leg at the proper point in a swing.

BACKGROUND OF THE INVENTION

Various aids, harnesses and the like have been developed for use by baseball or softball batters, golfers, tennis players, etc. to train them to swing in a proper manner. Since the swings in the different sports are each quite different, the aids are not transferably from one sport to another. For example, in a baseball swing, the elbow of the rear arm (right arm for a right-handed batter) must be kept up and away from the body and the lead arm down and near the body, while for a golf swing the rear elbow must be kept down and close to the body. Further, both feet are kept generally stationary during a golf swing, while a baseball batter will stride forward, toward the pitcher during a swing. Thus, golf swing training harnesses such as that described by Picard in U.S. Pat. No. 5,188,365 which keeps both elbows down to avoid "flying elbow" has no application to baseball swing training.

In a baseball or softball swing, in order to apply maximum poser in striking the ball, the batter's weight must shift to the rear leg at the start of the swing, then shift during the swing at a point during the usual forward stride that will provide the maximum impact on the ball from the combined arm swing, wrist snap and forward body movement.

Various devices have been developed to insure that a particular part of the body is held in a particular position before or during a swing. For example, Kisder in U.S. Pat. NO. 5,375,836 discloses a brace fastened to a player's body that has an arm and a support for the back elbow to keep the elbow up before a swing.

To allegedly aid in training a baseball player or golfer to properly shift weight during a swing, Ritchie in U.S. Pat. No. 5,470,055 describes a seat or saddle fastened to the upper end of a stanchion that is secured to the ground. The person sits on the saddle during a swing. There is nothing to indicate why this saddle actually influences weight shift during a swing.

A strap that is secured around a batter's torso and is connected to a strap around the bicep of the lead arm is disclosed by Gillespie et al. in U.S. Pat. No. 5,114,142 to restrain lifting of the lead elbow (so-called "chicken elbow") during a swing. This device has no influence on weight shift during a swing.

Martelli, in U.S. Pat. No. 5,009,420 describes a waist belt to be worn by a batter, with the belt fastened to a rigid structure so that the batter can rotate his hips during a swing but not move excessively toward the pitcher and bend his forward knee during the swing. Weight shift at the proper point in the swing is not influenced by this device.

Thus, there is a continuing need for apparatus and methods for teaching batters playing baseball, softball and closely related games to shift body weight back at the start of a swing and forward at an optimum point in the swing to produce maximum impact power and to avoid much less powerful "arm-only" swings.

SUMMARY OF THE INVENTION

The above-noted problems, and others, are overcome by an apparatus and method for training batters in baseball type games to properly shift weight before and during a swing, which basically comprises, in seriatim, a first strap for fastening around a batter's leading leg approximately just above the leading knee (in the lower thigh area), an elastic cord connected to the first strap, a length adjustable tether connected to said elastic cord and to a second strap sized to be placed around a batter's leading wrist.

The device of this invention will train a batter through muscle memory and through the entire swing, including initial coiling weight transfer through the forward stride and drive forward of body weight to the swing through of shoulders, arms and bat. These proper kinematics produce the greatest velocity of the bat through the hitting zone and will develop the most powerful swing the body can accomplish.

For the purposes of this invention "baseball" will be understood to refer to any baseball-like game, such as softball, over-the-line, stick ball, etc. in which a batter uses a bat to strike a thrown ball and strides forward as part of the overall swing motion. Also, "lead knee" or "lead elbow" will be understood to mean that knee or elbow on the side from which the ball is delivered, e.g., the left knee for a right handed batter.

Each of the first and second straps includes means for varying the circumference of the band to fit snugly around the lower thigh and wrist, respectively, and to permit quick and conveniently installation and removal. For maximum convenience, the second strap, for engaging the wrist, should include installation and removal means that permit installation and removal with one hand.

Preferably, the variable tether should include a snap buckle that allows the tether to be separated into two parts, so that a user may walk comfortably to or from the plate or other hitting location with both straps in place without interference with the training assembly, then easily connect it for use. The ideal snap buckle is the type that includes a socket on one part and an insert on the other, with the insert locking when inserted and releasing when squeezed sideways and pulled out. Such a buckle can be easily operated with one hand.

While any suitable elastic cord may be used, the knit cloth covered rubber cords generally know as "Bungee" cords have been found to give optimum performance.

In use, the first and second straps are secured to the leading lower thigh and wrist, respectively, and the length of the variable length tether is adjusted so that when the batter assumes the "ready" position preparatory to receiving a pitch the elongated combination of elastic cord and variable length tether are just taut. When a pitch is thrown, the batter's hands initially move back away from the pitcher, pulling on the lead leg. This take-up tension causes the batter to raise the forward foot just to the balance point on the ball of the foot of the lead leg, thus transferring weight to the rear foot. As the ball approaches, the batter strides forward, elongating the cord and causing weight to shift to the front leg. As the swing proceeds, the elongated means goes slack, so that through the swing and follow through there is no restrain and no hindrance of the swing. With this transfer of weight at the ideal point in the wing, the batter will generate the maximum amount of power to the hitting zone, so that the ball will fly sharply for the maximum distance.

BRIEF DESCRIPTION OF THE DRAWING

Details of the invention, and of preferred embodiments thereof, will be further understood upon reference to the drawing, wherein.

DETAILED DESCRIPTION OF PREFERRED MODES

Figure 1:
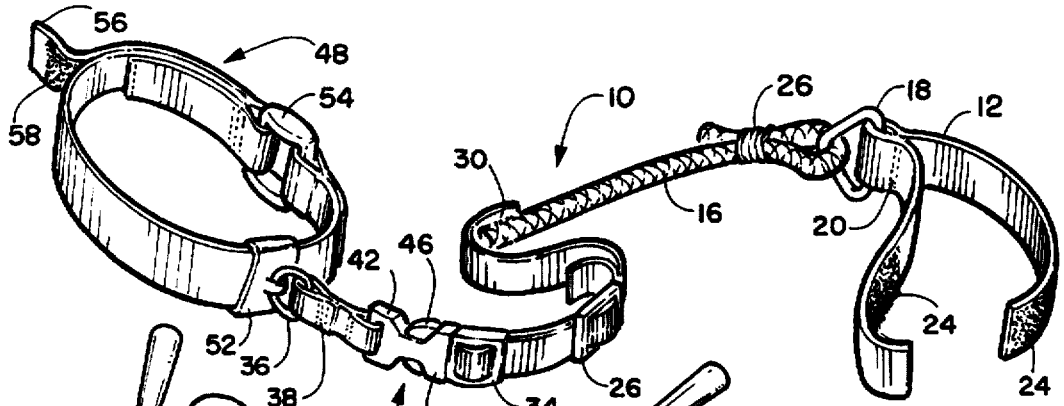
FIG. 1 is a perspective view of the training device of this invention.
Figure 2:
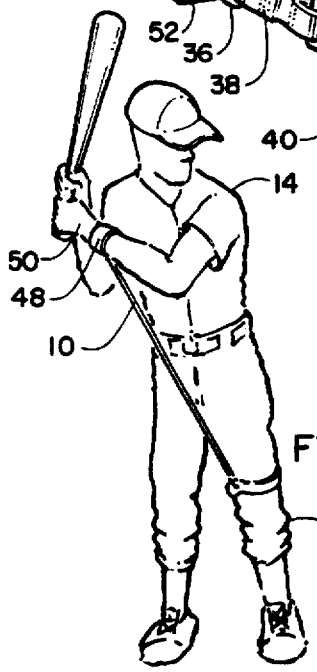
FIG. 2 is a perspective view showing a batter using the device in the ready position.

Referring to FIG. 1, there is seen the training device for use in training a batter the proper sequence of shifting weight to the back leg, then to the lead leg at the proper point in a swing.

An elongated member 10 carries a first strap 12 at one end which is sized to fit around the lead leg of a batter 14, as seen in FIGS. 2–5. First strap 12 is secured to an elastic cord 16 portion of elongated member 10 through a ring 18. First strap 12 includes stitches 20 to prevent the strap from separating from ring 18.

The loose ends of first strap 12 are releasably fastenable together to form a band having a circumference such as to tightly engage the lead leg 22 of batter 14, at the lower end of the thigh, just above the knee. While any suitable fastening means may be used, hook-and-loop material 24 of the sort available under the Velcro® trademark is preferred. One of the hook material and the loop material is secured to one end of first strap and the other material to the other strap end, so that they can be brought together in an overlapping relationship. This fastening is easily engaged and disengaged, is quite strong in shear and is easily fastened to produce any circumference and degree of tightness on the batter's leg.

Elastic cord 16, preferably the fabric covered rubber cord known as "bungee" cord is connected to ring 18 in any suitable manner, such as tie 26.

The second end of cord 16 is fastened to a variable length tether 28 to make up elongated member 10. Cord 16 can be fastened to tether 16 by any suitable means, such as clamps or stitching 30. The second end of tether 28 extends through two conventional buckles 32 and 34 that permit the over all length of tether 28 to be varied. The second end of tether 28 is secured to a ring 36 by stitching 38 or the like.

Tether 28 is divided and a snap buckle 40 is secured between the divided ends. Snap buckle 40 includes a female end 42 secured to one side of the divided tether 28 and a male end 44 connected to the other sided of the divided tether. In use the male end 44 is inserted into the female end so that spring tabs 46 interlock to hold the buckle together. Snap buckle 40 can be easily removed squeezing tabs 46. Thus, snap buckle 40 can be easily removed with one hand while a batter is waiting his turn for batting practice, then reinstall the system with one hand when his or her turn comes. This one hand operation is important because second strap 48 is secured to the lead wrist 50, making operation of a two-hand latch difficult, as detailed below.

Second strap 48 comprises a length of fabric, leather or the like having a connector 52 to which ring 36 is fastened. One end of strap 48 extends through ring 54 and is doubled back and fastened, such as by stitching. The second end 56 of strap 48 has cooperating portions of hook-and-loop material on the same side, spaced apart slightly, so that the second end can pass through ring 54 and the hook-and-loop material may be brought together with strap 48 around the lead wrist 50, as seen in FIGS. 2–5. The hook-and-loop material 58 does not extend to the very end of end portion 56, to leave a tab that can be grasped by the batter's other hand for installation and removal, since with the strap on the lead wrist, that hand cannot reach second strap 48.

Preferably, connecter 52 is secured to strap 48 near but spaced from ring 54, so that the batter can reach tab 56 and insert or remove it from ring 54 conveniently.

In use, a batter initially fits first strap 12 around his or her lower thigh just above the lead knee and fits second strap 48 around the lead wrist, generally with snap buckle 40 separated. Then snap buckle 40 is fastened and the end of strap passing through buckles 26 and 34 is adjusted so that the combination of cord 16 and tether 28 is taut but not stretched when the batter is in the "ready" position shown in FIG. 2 while awaiting a pitch. For clarity of illustration, details of cord 16 and tether 28 that make up elongated member 10 are not shown in FIGS. 2–5.

Figure 3:
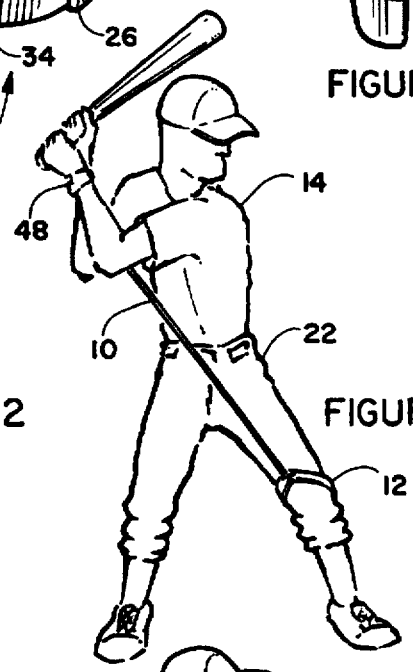
FIG. 3 is a perspective view showing a batter using the device striding forward at the beginning of a swing.

When a pitch is thrown batter 14, the batter brings his or her hands back, stretching cord 16 slightly and causing a weight shift to the back leg. Then as the batter begins the forward stride, as shown in FIG. 3 further stretching of the cord and the forward pulling cord forces will cause the batter to begin to shift weight to the forward leg. This shift of weight during the swing greatly increases the power of the swing at impact.

Figure 4:
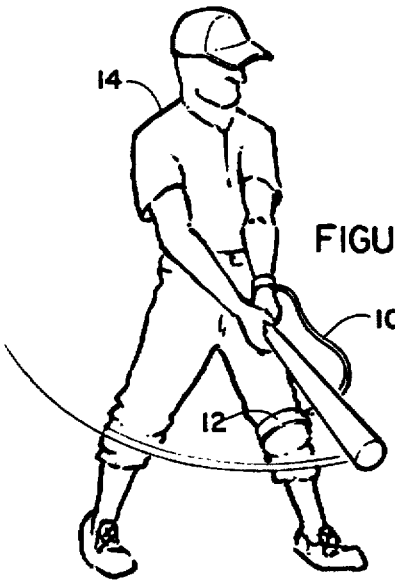
FIG. 4 is a perspective view showing a batter using the device at the ball contact point in the swing.
Figure 5:
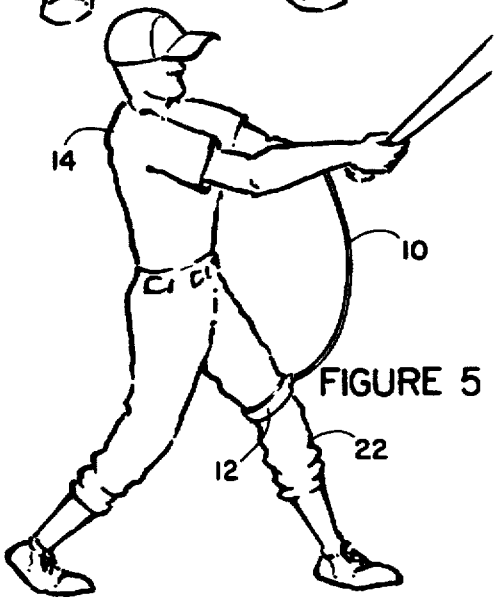
FIG. 5 is a perspective view showing a batter using the device at the follow through portion of the swing.

As seen in FIG. 4, weight shift has been completed and the ball has just been struck. Elongated member 10 is slack and does not interfere with the swing. No interference with the follow through illustrated in FIG. 5 will occur, since elongated member 10 remains slack.

Thus, it can be seen that the training device of this invention will encourage the desirable weight shift to the back leg, at the start of the swing, then will cause the necessary weight shift to the front leg during the forward stride and bat motion, climaxing at the point of impact of bat against ball. Once this weight shift becomes natural to the batter, he or she will continue to properly shift weight while swinging a bat without the training device. Snap buckle 40 can be released for comfort when the batter is walking around, waiting to bat, etc., without requiring removal of straps 16 and 48.

While certain specific relationships, materials and other parameters have been detailed in the above description of preferred embodiments, those can be varied, where suitable, with similar results. Other applications, variations and ramification of the present invention will occur to those skilled in the art upon reading the present disclosure. Those are intended to be included within the scope of this invention as defined in the appended claims.

I claim:

1. A training device for improving swing power for batters, which comprises:

a first strap for fastening to a batter's lead leg approximately just above the knee;

a second strap for fastening to a batter's lead arm at approximately the wrist;

elongated means for connecting to said first and second straps;

said elongated means comprising an elastic portion connected to said first strap and a variable length portion connected to said second strap; and a separable buckle in said variable length portion for disconnection and reconnection of said elongated means from said second strap by one hand.

2. The training device according to claim 1 wherein said variable length portion includes adjustment means to provide an elongated means length adjustable such that said elongated portion is taut when a person using said device assumes a normal batting stance.

3. The training device according to claim 1 wherein said first strap comprises a length of fabric material extending through a ring to which said elastic portion is fastened, said fabric material length having ends with cooperating hook and loop material on opposite surface so that overlapping said ends to a predetermined degree and bringing said cooperating hook and loop material together will form a closed ring of predetermined circumference.

4. The training device according to claim 1 wherein said second strap comprises a length of fabric material with a first end connected to an end ring and a second end having adjacent areas along said strap bearing cooperating areas of hook and loop material, so that said second end can be inserted through said ring and said second end folded back to bring cooperating areas of hook and loop material together to form a closed ring of predetermined length.

5. The training device according to claim 4 further including a loop secured to said second strap spaced from said end ring and means for connecting said variable length portion to said loop.

6. The training device according to claim 1 wherein said elastic portion comprises a length of rubbery material covered with a knit fabric cover.

7. A training device for improving swing power for batters, which comprises:

a first strap for fastening to a batter's lead leg approximately just above the knee;

a second strap for fastening to a batter's lead arm at approximately the wrist;

elongated means for connecting to said first and second straps;

said elongated means comprising an elastic portion connected to said first strap and a variable length portion connected to said second strap;

a separable buckle in said variable length portion adjacent to said second strap for disconnection and reconnection of said elongated means from said second strap by one hand; and said variable length portion includes adjustment means to provide an elongated means length adjustable such that said elongated portion is taut when a person using said device assumes a normal batting stance.

8. The training device according to claim 7 wherein said first strap comprises a length of fabric material extending through a ring to which said elastic portion is fastened, said fabric material length having ends with cooperating hook and loop material on opposite surface so that overlapping said ends to a predetermined degree and bringing said cooperating hook and loop material together will form a closed ring of predetermined circumference.

9. The training device according to claim 7 wherein said second strap comprises a length of fabric material with a first end connected to an end ring and a second end having adjacent areas along said strap bearing cooperating areas of hook and loop material, so that said second end can be inserted through said ring and said second end folded back to bring cooperating areas of hook and loop material together to form a closed ring of predetermined length.

10. The training device according to claim 9 further including a loop secured to said second strap spaced from said end ring and means for connecting said variable length portion to said loop.

11. The training device according to claim 7 wherein said elastic portion comprises a length of rubbery material covered with a knit fabric cover.

* * * * *